US006485585B2

(12) United States Patent
Krajewski

(10) Patent No.: US 6,485,585 B2
(45) Date of Patent: Nov. 26, 2002

(54) METHOD FOR MAKING SHEET METAL COMPONENTS WITH TEXTURED SURFACES

(75) Inventor: Paul Edward Krajewski, Sterling Heights, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/792,106

(22) Filed: Feb. 26, 2001

(65) Prior Publication Data

US 2002/0117238 A1 Aug. 29, 2002

(51) Int. Cl.[7] ..... C22F 1/04
(52) U.S. Cl. ..... 148/564; 148/692; 148/696
(58) Field of Search ..... 148/564, 689, 148/692, 696

(56) References Cited

U.S. PATENT DOCUMENTS

| | | | | |
|---|---|---|---|---|
| 4,021,271 A | * | 5/1977 | Roberts | 148/551 |
| 5,819,572 A | | 10/1998 | Krajewski | 72/42 |
| 5,974,847 A | | 11/1999 | Saunders et al. | 72/57 |
| 6,047,583 A | | 4/2000 | Schroth | 72/60 |

* cited by examiner

*Primary Examiner*—George Wyszomierski
(74) *Attorney, Agent, or Firm*—Kathryn A. Marra

(57) ABSTRACT

Pre-straining and thermal recrystallization processes for maximizing formability in SPF sheet alloys of aluminum, magnesium, iron and titanium can be modified to form sheet products with roughened or textured surfaces for low-slip applications or coating adherence or decorative applications. By determination of suitable pre-strain levels and recrystallization/forming temperatures for s sheet metal stock, relatively large grained microstructures are formed in the sheet that yield useful surface texture during forming.

8 Claims, 1 Drawing Sheet

METHOD FOR MAKING SHEET METAL COMPONENTS WITH TEXTURED SURFACES

TECHNICAL FIELD

This invention pertains to the processing of certain metal alloys to produce an orange peel-like textured surface. More specifically, this invention pertains to the controlled cold working of a superplastic-formable (SPF) metal alloy sheet so as to yield a roughened textured surface in at least a portion of the sheet upon stretch forming at a suitable elevated temperature and strain rate.

BACKGROUND OF THE INVENTION

There are families of metal alloy compositions that when subjected to suitable thermomechanical processing display extraordinary elongation or plastic deformation properties. They are then said to have superplastic forming properties (or to be superplastically formable, either phrase sometimes abbreviated as SPF). Some aluminum, iron, magnesium and titanium compositions have such properties. Often SPF materials have a metallurgical microstructure characterized by a matrix phase of the major constituent such as aluminum, or of a solid solution of the major phase and minor alloying elements, and very finely divided dispersed phase of intermetallic material. Materials with such a microstructure are sometimes called pseudo-single phase materials because of the very small dispersed phase. In sheet form, such materials can be cold rolled to reduce thickness and increase length while breaking up the existing grains and storing the work energy in the microstructure of the sheet. Then, upon heating to a suitable temperature, the strain is relieved by recrystallization to yield a very fine grain microstructure susceptible to forming operations at a suitable temperature to produce complex shapes from the sheet in which portions have experienced extraordinary elongation and deformation.

Certain SPF titanium alloy sheet compositions (e.g., Ti-6% Al-4% V alloys) have probably been the first materials to be used commercially. They have been used in the aerospace industry because of their very favorable strength-to-weight ratio. These sheet materials are formed at suitable elevated temperatures in the range of, for example, 800° C. to 900° C. into complicated one-piece shapes that often eliminate the previous need to form several smaller pieces and join them together. The sheets experience strain rates of $10^{-4}$ to $10^{-3}$ and elongation of several hundred percent. The need of the aerospace industry for strong lightweight parts has permitted the use of expensive alloys and relatively slow manufacturing processes. At present, however, SPF practices with titanium alloys have been too expensive for the lower cost requirements of the automobile industry.

Work has begun to adapt some aluminum alloys to lower-cost SPF processes and part manufacture. For example, AA 5083 has been formed by hot rolling of a cast ingot to a strip and subsequent severe cold rolling of the strip to a sheet material that is a precursor for SPF part manufacture. AA5083 have typical compositions, in weight, of about 4% to 5% magnesium, 0.4% to 1% manganese, 0.05% to 0.25% chromium, about 0.1% copper, and the balance aluminum. The cold-rolled sheets are heated to a suitable temperature of, e.g., about 500° C. where recrystallization to a fine grain (about 10 m) microstructure quickly occurs and the sheet is warm enough to be formed with relatively high elongation for such alloys. The heated sheet is placed adjacent a suitable forming tool, secured at the edges and stretched against and into compliance with the forming tool using the pressure of a gas such as air, nitrogen or argon.

SPF practices for the stretch forming of aluminum alloys such as AA5083 are illustrated in patents such as U.S. Pat. No. 5,819,572 Krajewski, "Lubrication System for Hot Forming;" U.S. Pat. No. 5,974,847 Saunders et al, "Superplastic Forming Process;" and U.S. Pat. No. 6,047,583 Schroth, "Seal Bead for Superplastic Forming of Aluminum Sheet," each assigned to the assignee of this invention. As suggested in these patents, the goal in developing SPF practices for the manufacture of aluminum sheet products on a commercial scale has been to make tear-free articles with unmarred surfaces. But it would also be useful to form sheet metal products with SPF-like capabilities that have textured, or uniformly roughened surfaces, in at least a portion of the article. In other words, there are applications for SPF-type formed parts that have an orange peel-like surface of decorative or anti-skid properties or the like.

SUMMARY OF THE INVENTION

This invention provides a method of forming a SPF-type metal alloy sheet of specified thickness so that at least a portion of the resulting product has a surface with a visible uniform rough texture like the skin of an orange. The invention is applicable to metal alloys that can be cold worked to a sheet stock precursor having a suitable strained microstructure that will recrystallize to a fine-grained microstructure with high elongation characteristics upon heating to a recrystallization (and forming) temperature. The practice of the invention involves predetermining the amount of cold work that is to be applied to the precursor sheet stock so that, upon heating to a superplastic-forming temperature for the material and subsequent stretch forming, the deformation of the sheet results in a desired shape and the textured surface. For applications such as the manufacture of automobile body panels, SPF aluminum alloys are preferred because of their combination of low weight, high strength and low cost.

The preparation of a superplastic-formable, aluminum alloy sheet stock usually begins with a casting of a suitable composition such as AA5083. The cast material is then reduced in thickness by hot rolling to a strip that may, for example, have a thickness in the range of 20 to 40 millimeters depending somewhat on the goal for the final thickness of the sheet. The hot rolled strip is then cold rolled, usually in stages with possible interposed anneals, to a final thickness in the range of about one to three or four millimeters. The result of overall thermomechanical processing is typically a coil of smooth surface aluminum sheet stock, the microstructure of which has been severely strained. This material is then ready to be heated to 500° C. or so for stretch forming as described above. The effect of the heating is to promote recrystallization of the severely worked microstructure to a very fine grained material susceptible to appreciable elongation during deformation by stretching against the forming tool.

In conventional superplastic forming of aluminum sheet, the goal is to obtain a sheet stock of desired thickness that ends up with a suitably fine grained microstructure to sustain deformation and elongation at the various critical spots on the sheet to form the desired part with at least one smooth surface and without body tears, ruptures, undue thinning and the like. In order to assure suitable elongation for any SPF job, the current sheet stock rolling practice is to maximize the cold rolling strain imposed on the sheet stock consistent with the specified thickness of the sheet stock. Depending upon the shape of the part to be formed, the sheet stock may then have sufficient or excess elongation (i.e., formability) for the task.

In accordance with this invention, a sheet product is formed from a stock material having marginally less formability than SPF starting material. The shape of the product will not require the extensive deformation obtained in an SPF process, but the product, upon heating to a suitable elevated temperature and stretch forming, will have a generally uniformly roughened surface portion. The amount of cold rolling strain imposed on the sheet is carefully determined to be less than that required for optimum SPF deformation but sufficient to make the part and to yield the textured surface. In other words, the creation of the textured surface is the result of a cold working and thermal recrystallization strategy that produces a defective part as far as SPF processing is concerned, i.e., a part with a roughened surface. Manufactured sheet metal parts with rough surfaces have utility for decorative purposes, low slip applications, coating adhesion, controlled heat transfer and the like.

Other objects and advantages of the invention will become more apparent from a detailed description of preferred embodiments which follows.

DESCRIPTION OF THE PREFERRED EMBODIMENT

Figure 1:
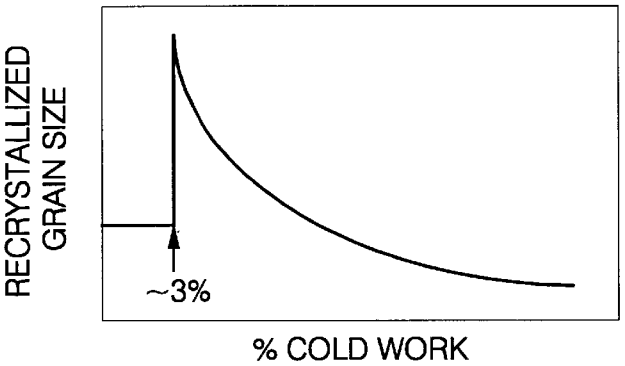
FIG. 1 is a graph illustrating recrystallized grain size as a function of percentage reduction of a sheet by cold work.

It is believed that the invention can be well illustrated by comparison with conventional SPF technology as applied to the stretch forming of AA5083 material.

Currently, AA5083 material is supplied for some SPF manufacturing operations in the H18 temper designation condition. The H18 designation means that the material was cold rolled at a temperature not exceeding about 50° C. for significant periods of time to a reduction of 74% or more as the last processing step, thereby producing a very "hard" material. The coil does heat up during cold rolling and, therefore, the rolling is often carried out in multiple steps so that the coil can cool, sometimes overnight, between steps. In other words, originally cast material is hot rolled to a desired intermediate thickness, fully annealed and then cold rolled without intermediate anneal to about one-quarter of its annealed thickness. The final thickness of the cold-worked sheet is typically in the range of one to two millimeters.

When the H18 AA 5083 blank is heated to a suitable SPF-forming temperature, e.g. 500° C., the energy stored in the sheet microstructure by the cold-working process is released through the recrystallization of new grains or crystals in the material. The higher the amount of cold work prior to heating, the more nuclei/unit volume form, which then leads to a finer and more uniform grain size. This is advantageous for the SPF process as finer grains produce better formability which allows products with more complex geometries to be formed in less time. In addition, the fine, uniform grain structure produced by this process also leads to smooth surface finishes in as-formed components. Thus, for the above reasons, SPF material has been typically produced with the finest grain size possible.

While a fine grain size is desired for optimum formability of complex panel shapes, some components can be manufactured with less than optimum material. For example, one panel shape may require a material to exhibit a minimum of about 300% elongation under stretch forming conditions of 500° C. and at a strain rate of 0.001/sec while a different panel can be successfully made using material which exhibits significantly less elongation under these conditions. Another body closure inner panel shape requires AA5083 material with an elongation of nearly 400% to make a reasonable cycle time. Thus, it is clear that a significant difference exists in the quality (meaning the elongation or deformability) of material required for different body panel SPF-forming applications. When the sheet stock is processed to have suitable formability to make a specified part shape the part can be stretch formed at 500° C. or so quickly without incurring tears or ruptures in the part and without surface defects resulting from uneven deformation of the microstructure. However, there may be some parts in which a surface texture is wanted. In order to produce such parts, one must rethink the strategy that leads to successful SPF part making.

In the case of automobile parts, for example, one might want aluminum truck running boards with textured low-slip surfaces, underbody panels with rough surfaces for coating retention, heat shields or floor pans with enhanced thermal radiation surfaces, or interior trim surfaces with decorative textured surfaces.

Applications requiring a "textured surface" require a method for using formable sheet material which exhibits less than optimum SPF utility but exhibits a post-formed surface that could create styling or marketing advantages otherwise unattainable. Satisfaction of this requirement involves a new way of using the known phenomena of critical strain recrystallization to produce SPF-type material with larger grains than those typically needed and used in the SPF process. The details of critical strain recrystallization are re-examined.

The grain size of a metal sheet can be controlled by the application of cold work or strain followed by a recrystallization heat treatment. The relationship between cold work (% CW or percentage reduction in thickness of the sheet) and grain size for an alloy like AA5083, for example, is shown generically and schematically in FIG. 1 where the X axis represents the amount of % CW added to O temper (dead soft) material and the Y axis represents the grain size produced by recrystallizing the material after the CW addition.

For small amounts of cold work (<3%), no change in grain size occurs after heat treating because no nuclei for recrystallization are formed. At some critical cold work level (typically between 3% and 5% for AA5083), a few nuclei are formed during heat treatment which produces a very large recrystallized grain size. As the amount of cold work or strain is increased, the amount of stored energy increases and thus the number nuclei also increases. As a result, the recrystallized grain size is smaller. Typically, SPF materials are produced by processing to the far right of curve in FIG. 1 where the high amount of cold work produces a large number of nuclei and thus a finer grain size, e.g., less than about 10 micrometers. The idea in the present method thus involves producing material by processing in the middle range of cold work where large grains can be produced. The cold work which is represented in FIG. 1 is cumulative as long as the material is not heat treated in between separate rolling events. Thus, sheet material given 3% cold work in one pass and 10% cold work in another pass would provide a grain size corresponding to 13% cold work in FIG. 1 after a recrystallization heat treatment.

This phenomena of grain size control in SPF materials can be achieved in current production practices using one of the following methods:

(1) The AA5083 material supplier produces standard H18 temper material slightly over the required thickness. The entire coil would then be passed through a continuous annealing line, or the entire coil could be flash annealed. This would convert the coil to O temper, essentially dead soft material. The coil would then be cold rolled to a thickness reduction (in percent of the original thickness of the O temper sheet) corresponding to the resulting grain size desired (e.g., 10% reduction) as experimentally determined (as in FIG. 1) for the specific part to be formed. The material could then be recrystallized either at the aluminum mill or during heat-up in the SPF part-making process.

(2) A current production process could be varied by replacing the 74% cold work in the final process step with the critical amount of cold work (e.g., 10% after an intermediate anneal) required to produce the desired grain size. This method may have two potential disadvantages. First, the material is not necessarily in the O temper after warm rolling, thus the starting point of the material would be unknown and the resulting surface texture could vary. This could pose a problem when trying to hit a very specific cold work level. Secondly, the formability could be lower with this process as the orientation of the large recrystallized grains may not be as random as they would be with the extra recrystallization step in #1.

(3) Material could be supplied to the user in the O temper (H18 material which was flash annealed at the supplier). The critical amount of strain could be applied to the blank prior to forming either by bending, rolling or other mechanical means. This process would be difficult to control as the amount of cold work may not be uniform across the blank prior to placing in the SPF press, thus producing an irregular microstructure and therefore an irregular surface.

Experimental

A cold-rolled sheet stock of AA5083 material was used. The sheet stock was annealed to a soft condition (O temper designation). One AA5083-O material was pre-strained by cold rolling to a 5% reduction in the thickness of the and a second sheet of the same material pre-strained to 10% reduction. This work was done by a supplier on a rolling mill.

The respective sheet samples were stretch formed at 500° C. against a tool shaped to form the license plate pocket region and adjoining surface region of an automobile decklid. This pocket region is an example of a relatively difficult part to form because it is of box-like shape with a flat bottom portion and steep sides and ends. The dimensions of the pocket were 520 mm long by 180 mm wide by 52 mm deep. The sheet samples were respectively heated to 500° C., clamped at their periphery over the female tool and pressed into close conformance with the tool surface by gradually increasing air pressure to a maximum level of 90 psi. The parts were formed after about six minutes of pressure application. The formed sheet license plate pockets were removed and cooled.

Figure 2:
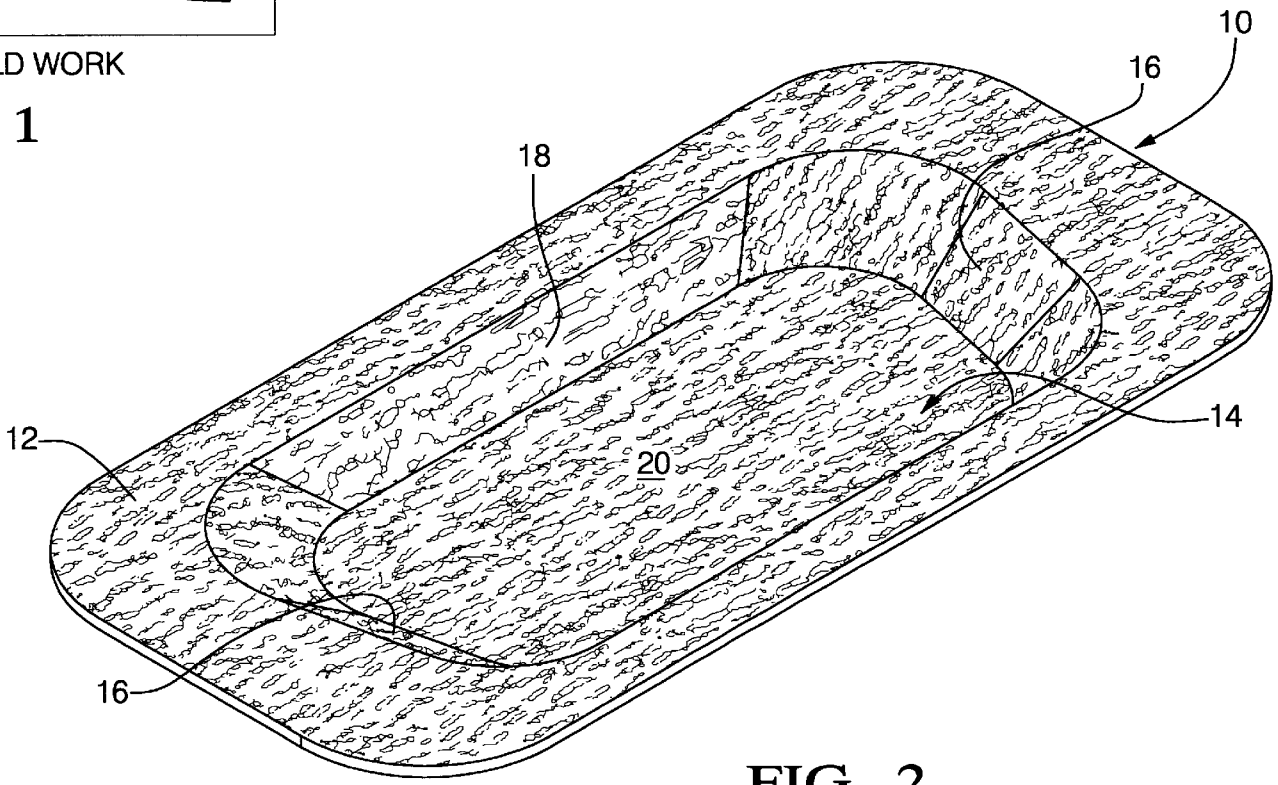
FIG. 2 is a draftsman's sketch of a portion of an AA5083 sheet formed with a license plate pocket such as might be formed in an automobile decklid panel. But the formed sheet has also been formed with a textured surface as produced by a practice of this invention.

A trimmed sheet is illustrated in FIG. 2. The formed sheet 10 included a flat peripheral portion 12 surrounding a license plate pocket portion 14. The license plate pocket portion included fairly steeply sloped segmented side walls 16 and a top 18 and a bottom wall, obscured in this view. The pocket 14 also included a flat bottom 20.

The AA5083 sheet sample pre-strained to 10% successfully formed the license plate pocket member without tear or rupture but the 5% prestrained sheet did not. Both sheets exhibited a rough, orange peel appearance over the entire part 10 after forming as illustrated by artist's sketch of FIG. 2. The 10% pre-strained sheet had a finer grain structure to begin with, and it formed the part better, but its surface was less rough. Thus, depending upon the textured desired on the surface of the final part, one might specify an initial pre-strain amount of, for example, 5+% to 15%. Obviously, a balance must be accepted between the complexity of the SPF part to be formed and the roughness characteristic of the formed surface.

The subject surface texture forming process can be adapted to alloys which exhibit critical strain recrystallization phenomena such as aluminum, magnesium, steel and titanium. Suitable pre-strain levels for the surface texture desired can be established. In the case of AA5083, typical pre-strain levels for the roughened surface are in the range of about 3% to about 15%. Some latitude in the annealing and forming temperature is permitted. For example, in the case of AA5083, lower forming temperatures like 350° C. increase surface roughness while reducing formability. Obviously, there is latitude in the timing and location of the pre-strain step and the recrystallization step.

While the invention has been described in terms of some embodiments, it is appreciated that other forms could readily be adapted by persons skilled in the art. Accordingly, the scope of the invention is limited only by the scope of the following claims.

What is claimed is:

1. A method of plastically deforming a cold-worked metal alloy sheet to produce an article having a an orange peel textured surface portion, said alloy being of a composition that undergoes recrystallization at a recrystallization temperature after sustaining a critical cold work strain level, the grain size of the product of said recrystallization being an inverse function of said strain level and the formability of said recrystallization product being a direct function of said strain level, said method comprising determining the amount of cold work strain required to form a sheet metal precursor of predetermined thickness of said alloy that, upon sheet recrystallization and sheet forming at a predetermined temperature at or above said recrystallization temperature, said precursor yields a said article having said orange peel textured surface portion, and thereafter subjecting a sheet of said alloy to said amount of cold work strain to form said sheet metal precursor, heating said precursor sheet to obtain said recrystallization and to allow said forming, and forming said sheet to obtain said orange peel textured surface.

2. A method as recited in claim 1 in which said alloy is of a superplastic-formable composition.

3. A method as recited in claim 2 in which the composition of said alloy comprises more than half of an element selected from the group consisting of aluminum, iron, magnesium and titanium.

4. A method of plastically deforming a cold-worked aluminum-based alloy sheet to produce an article having a an orange peel textured surface portion, said alloy being of a composition that undergoes recrystallization at a recrystallization temperature after sustaining a critical cold work strain level, the grain size of the product of said recrystallization being an inverse function of said strain level and the formability of said recrystallization product being a direct function of said strain level, said method comprising determining the amount of cold work strain required to form a sheet metal precursor of predetermined thickness of said alloy that, upon sheet recrystallization and sheet forming at a predetermined temperature at or above said recrystallization temperature, said precursor yields a said article having said orange peel textured surface portions, and thereafter subjecting a sheet of said alloy to said amount of cold work strain to form said sheet metal precursor, heating said precursor sheet to obtain said recrystallization and to allow said forming, and forming said sheet to obtain said orange peel textured surface.

5. A method as recited in claim 4 in which said alloy is an aluminum-based alloy composition comprising by weight three to six percent magnesium.

6. A method as recited in claim 4 in which said alloy is AA5083.

7. A method as recited in either claim 5 or 6 in which said critical strain is about three percent strain.

8. A method as recited in either claim 5 or 6 in which the amount of cold work strain to form said precursor is in the range of about three percent to 15 percent strain.

* * * * *